US006408484B1

(12) United States Patent
Vandertouw

(10) Patent No.: US 6,408,484 B1
(45) Date of Patent: Jun. 25, 2002

(54) DOOR POSITIONING MEANS

(76) Inventor: Johan Martin Vandertouw, 113 Galston Road, Hornsby Heights, New South Wales (AU), 2077

( * ) Notice: Subject to any disclaimer, the term of this patent is extended or adjusted under 35 U.S.C. 154(b) by 0 days.

(21) Appl. No.: 09/554,472

(22) PCT Filed: Sep. 15, 1998

(86) PCT No.: PCT/AU98/00754

§ 371 (c)(1),
(2), (4) Date: Jul. 17, 2000

(30) Foreign Application Priority Data

Sep. 15, 1997 (AU) ..... 37590/97

(51) Int. Cl.[7] ..... E05D 11/10
(52) U.S. Cl. ..... 16/320; 16/82; 16/374
(58) Field of Search ..... 16/320, 374, 375, 16/82, 50; 49/381, 382, 386, 394; 292/DIG. 17, 251.5

(56) References Cited

U.S. PATENT DOCUMENTS 4,063,330 A * 12/1977 Triplette ..... 16/82
4,434,524 A * 3/1984 Gilchrist ..... 16/320
4,995,658 A * 2/1991 Shiraki et al. ..... 292/201
5,076,623 A * 12/1991 Richards ..... 292/251.5
6,149,212 A * 11/2000 Kuntz et al. ..... 16/82

FOREIGN PATENT DOCUMENTS

EP 0756056 A1 * 1/1997
FR 2694042 A1 * 1/1994

* cited by examiner

*Primary Examiner*—Chuck Y. Mah
(74) *Attorney, Agent, or Firm*—Abelman, Frayne & Schwab

(57) ABSTRACT

A door positioning means (11,15) for a hinged door (3) where the positioning means includes a first member (11) which is for stationary mounting and which is provided with a magnet array (18,19 and/or 20) disposed along a curved path to be located concentric with the axis of hinging of said door (3), a magnetic second member (16) for mounting on a door end (2 or 4) in closely spaced relationship to the first member (11) where the second magnetic member (16) has a polarity opposite to that of one of the magnet (18) of the magnet array which is disposed on said path at a position corresponding with the door closed position and which is different to that of the polarity of the other magnet(s) (19 or 20) in said array which are disposed adjacent to but spaced from the door fully open position(s).

36 Claims, 4 Drawing Sheets

DOOR POSITIONING MEANS

Figure 1:
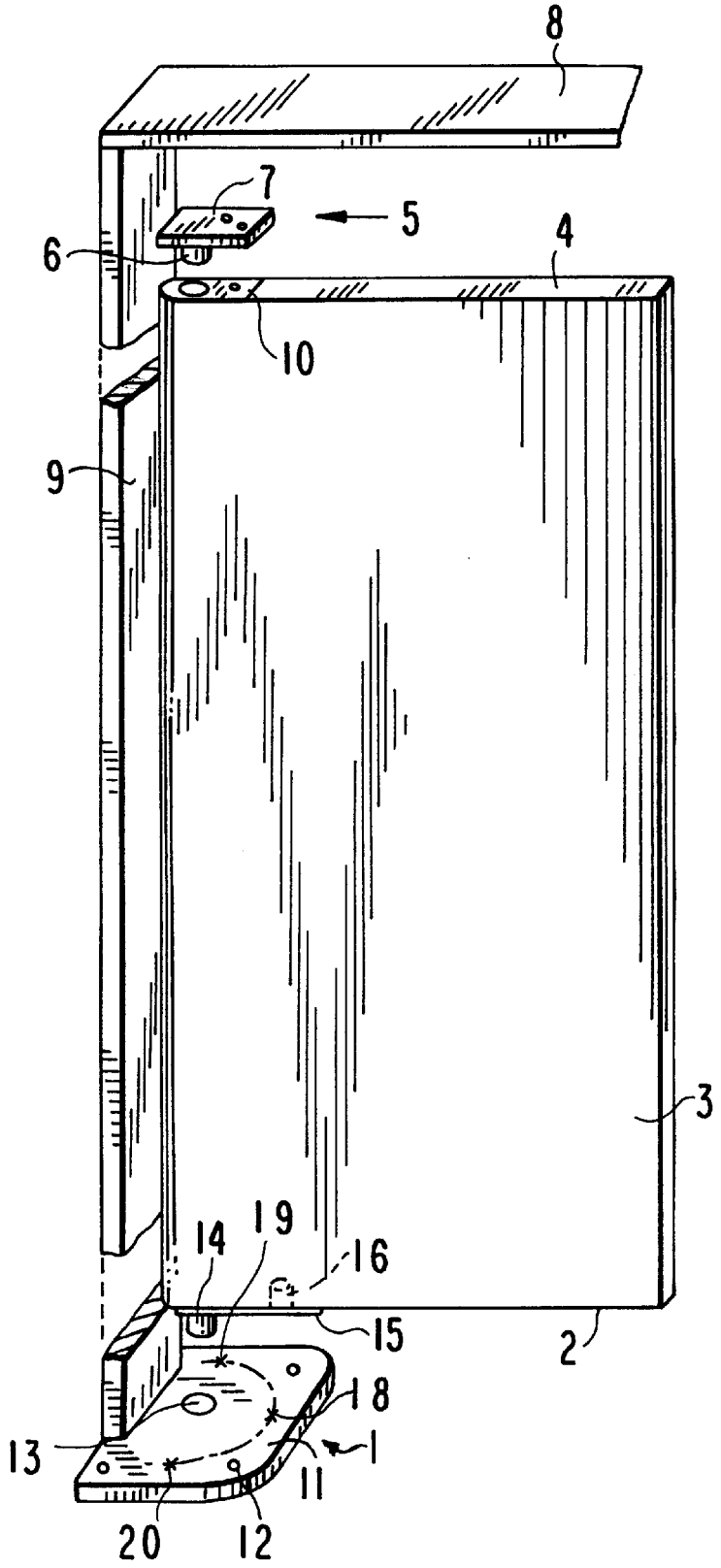

This invention relates to door positioning means, and in particular to means to bias a door to the closed position and releasably retain it in that position. In one form of the invention the door positioning means can also bias a partly open door to the fully open position.

The principal function of the present invention is to act as a door closer. Many, forms of door closers have been devised in the past and some also retain a door in an open or part open condition as well as exerting a door closing force.

One form of such closer links the door to a door surround and includes means to bias the door to the closed condition and hold it in an open position. Such A closers rely on pneumatics or hydraulics for their operation and only allow approximately 90 degree door opening in a single direction. Besides the drawback of limiting the door opening to 90 degrees, hydraulic closers are reasonably complex and therefore expensive.

Door closers of the single and double spring type have been developed for 90 degree and 180 degree door opening actions. This form of closer is noisy in action and is subject to spring fatigue. The action of this form of closer is severe and can be dangerous to elderly persons and children. In addition, this form of closer does not incorporate a door hold-open capability.

A cam form of hinge has been developed for doors required to move through 180 degrees and be held in the closed and both fully open conditions. This form of hinge also biases the door to the closed position when the door is moved from the open position. This form of hinge involves vertical movement of the door during the door swinging action and is therefore limited in its application.

There is thus a need for a door positioning means which can work with doors intended for 90 degree and 180 degree opening and which can bias a door to a closed condition and hold the door in closed and not be limited in operation by the manners of operation of known door closers and positioning means. In a preferred arrangement the door positioning means would also be able to position a door in a partly open or fully open position.

Broadly stated, the present invention provides a door positioning means to releasably retain a hinged door in a closed position and bias a part open door from the part open position towards a closed or fully open position dependent upon the degree to which said door is open, said positioning means includes a first member for stationary mounting in juxtaposition to the top or the bottom of a door and having a magnet array disposed along a path which when said first member is mounted will be substantially concentric with the axis of hinging of said door, said magnet array including a first polarity first magnet means corresponding with a door closed position and an opposite polarity second magnet means spaced from the first magnet means along said path by a distance less than that traversed by the door in moving between the closed and fully open positions, a second member also having said opposite polarity for mounting on the door at a distance from the axis of pivoting of the door such that said second member will traverse said curved path, said first and second members in use having a spacing there between such that attraction and repulsion forces will develop between the second member and the first and second magnet means.

Figure 2:
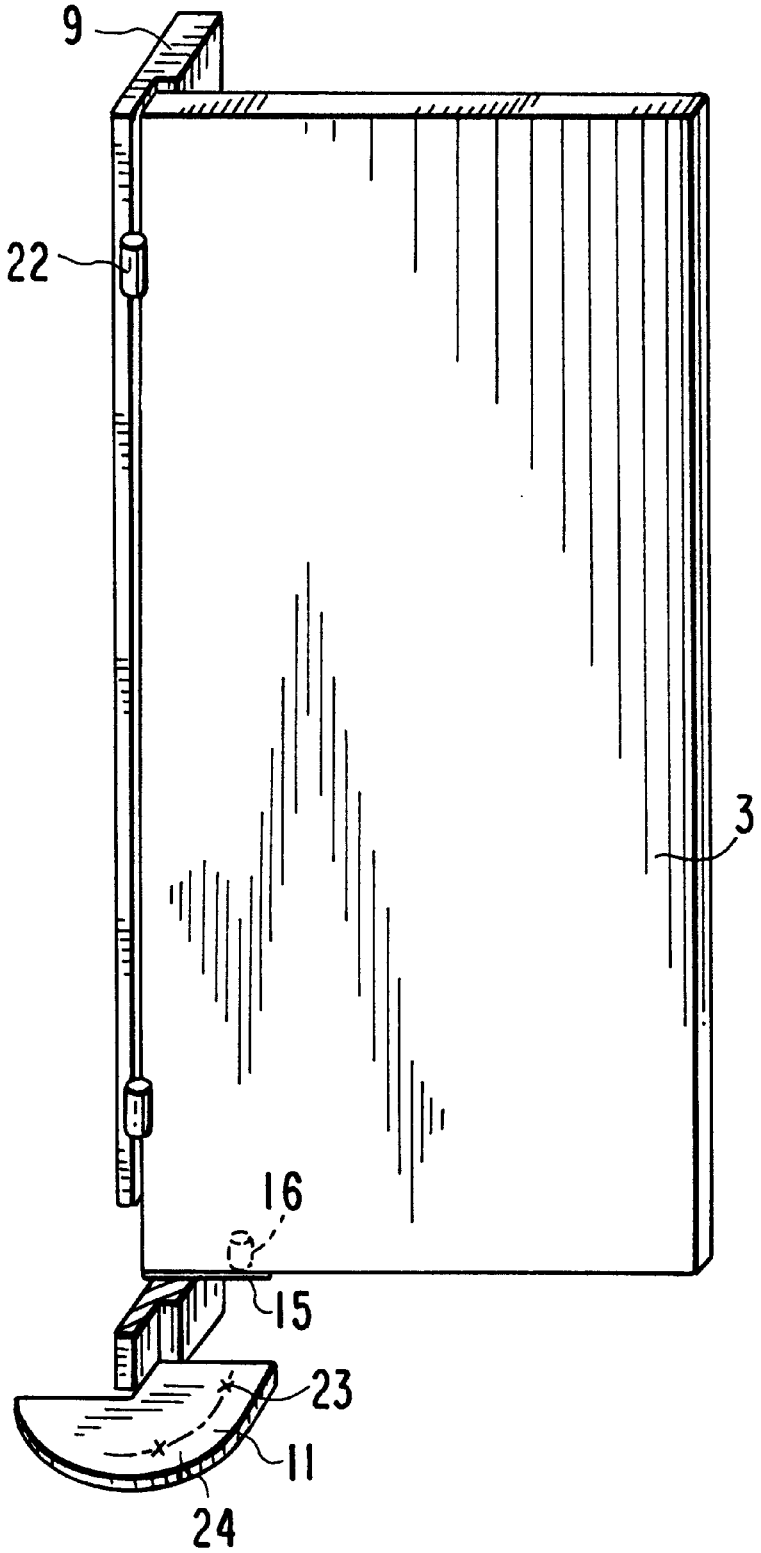
Figure 3:
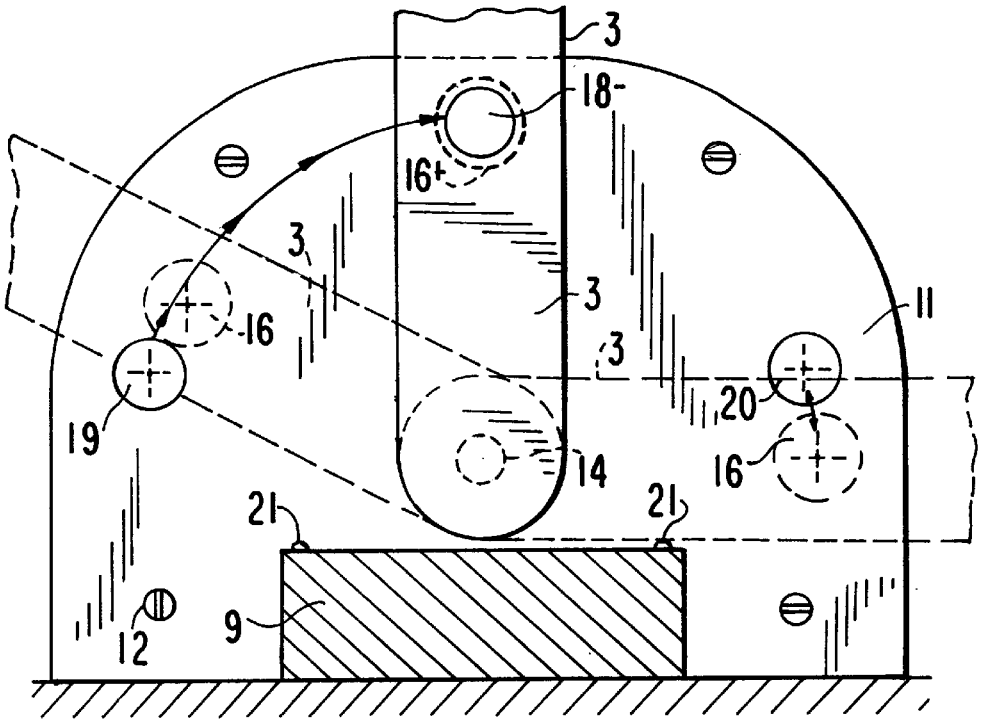
Figure 4:
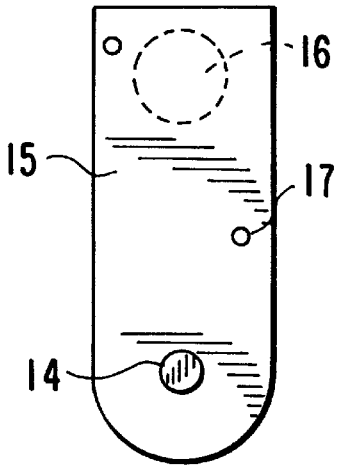
Figure 5:
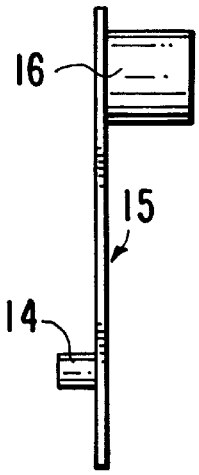
Figure 6:
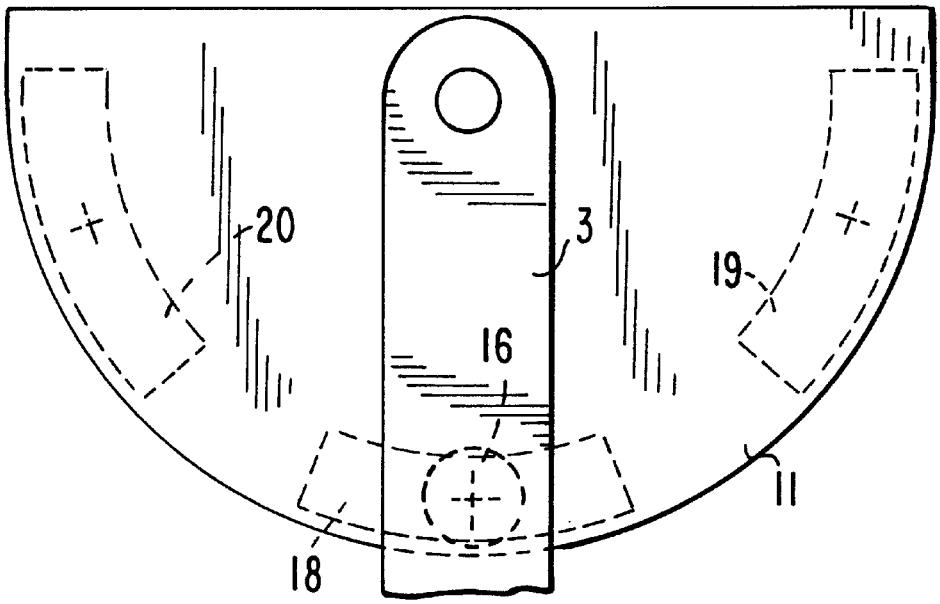
Figure 7:
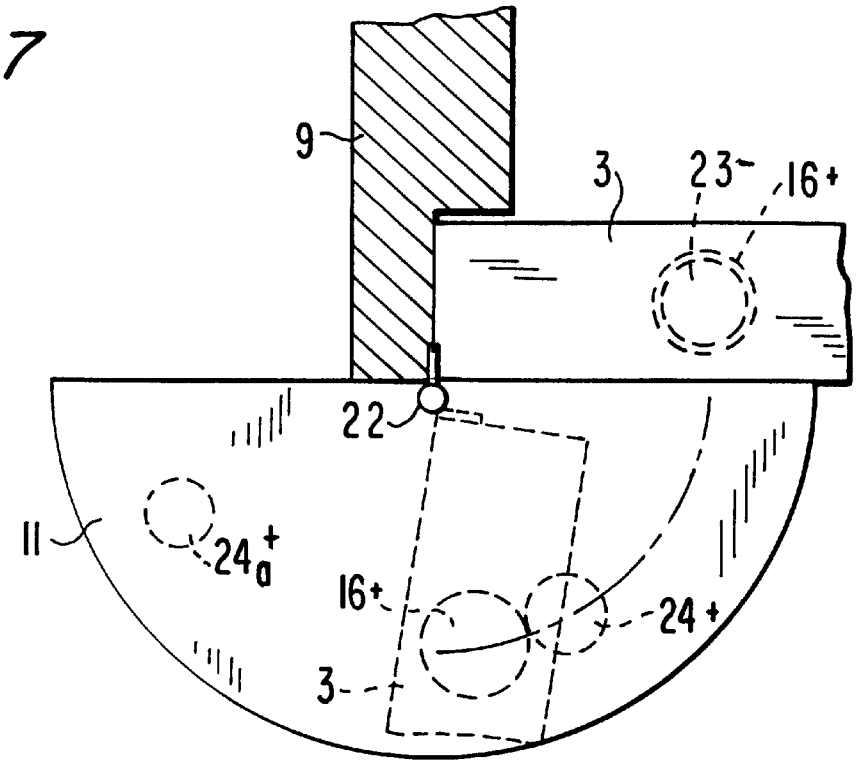

Preferred embodiments of the invention will now be described with reference to the accompanying drawings in which:

FIG. 1 a fragmentary view of a 180 degree opening door shown mounted with one form of the hinge assembly according to the invention, FIG. 2 is a view similar to FIG. 1 where a 90 degree opening door is shown mounted, FIG. 3 is a schematic top view showing the manner of operation of the door positioning means for a FIG. 1 arrangement, FIG. 4 is a plan view of a door mounting component as would be used in the connection of a door to a mounting plate in a FIG. 1 arrangement, FIG. 5 is a side view of the component of FIG. 4, FIG. 6 is a schematic illustration of a variation of the arrangement shown in FIG. 5 and FIG. 7 schematic top view showing the manner of operation of the door positioning means for a FIG. 2 arrangement.

In FIG. 1 the numeral 1 indicates a hinge assembly configuration of the present invention whereby the bottom edge 2 of the door 3 is pivotally connected to the floor. The door 3 is shown mounted at its top 4 through a pivot pin assembly 5 comprised of a pin 6 on a plate 7 adapted to be fixed to the head 8 of a door frame which includes a stile 9. The pin 6 is adapted to engage in a hole in a plate 10 mounted to the top 4 of the door. It is to be understood that the connection between the door top 4 and the door frame head 8 is representative and forms no part of the invention and can be replaced by any other similarly functioning arrangement.

The hinge assembly 1 includes a plate 11 shown as having holes 12 whereby the plate 11 can be fixed to a floor. There is a socket 13 to receive a pin 14 fixed to the bottom 2 of the door. The pin 14 is part of a mounting plate best seen in FIGS. 4 and 5. The mounting plate includes a body part 15 to which the pin 14 is fixed and it includes a magnet means 16 extending away from the body 15 in the opposite direction to the pin 14. The plate body 15 is provided with holes 17 where by the plate body 15 can be fixed to the bottom 2 of the door with the magnet means 16 housed in a recess in the door bottom 2. In use there would preferably be a friction minimising washer over the pin 14 and separating the plates 11 and 15.

The plate 11 has an array of magnet means, in this case three in number. One magnet means 18 is positioned so as to be in alignment with the door 3 when it is its closed position and so as to be in register with the magnet means 16 fixed to the door and to be closely spaced thereto. The other magnet means 19 and 20 are positioned as indicated and lie on a curved path that will be traversed by the magnet means 16 as the door 3 is moved through 180 degrees. The functioning of the door positioning means of the invention will now be described with reference to the FIG. 3.

In FIG. 3 the door 3 is shown in full lines in the closed position. It will be understood that in this position when the adjacent poles of the magnet means 16 and 18 are of opposite polarity (for convenience shown as positive on the magnet 16 and negative on the magnet means 18) there will be attraction and the door 3 will be retained in the closed position as a result of that attraction.

The upwardly facing pole of the magnet means 19 has a polarity the same as that of the lower end of the magnet means 16. It follows that as the door 3 is opened anti-clockwise to the position shown in broken lines there will be repulsion between the magnet means 16 and 19 tending to move the door 3 towards the magnet 18. If that repulsion is sufficiently great the door 3 will be moved sufficiently to come within the magnetic field of the magnet 18 and the door will be drawn towards the closed position.

If the door is opened sufficiently in the anti-clockwise direction to position the magnet means 16 beyond the magnet means 19 then the repulsion between the two magnet means will tend to move the door 3 to the open position and the movement in that direction will cause the door 3 to engage a movement buffer stop 21. This can be seen in FIG. 3 where a door 3 in dotted outline is shown in the position it would occupy if opened clockwise.

Referring to FIG. 6, the magnet means 18,19,20 are elongated but are still of the type having their upper faces of one polarity, respectively negative of the magnet means 18 and positive for the magnet means 19 and 20, as in the FIG. 6 arrangement. It is a feature of magnet means of the elongated type that where another magnet means, for example a pot type magnet in the bottom edge 2 of the door 3, is of opposite polarity to the adjacent pole of the elongated magnet 18, there will be a tendency for the pot magnet means 16 when located over the magnet means 18 to position itself at the mid-length of the elongated magnet 18, that is in the illustrated arrangement, in a position in which the door is fully closed.

Likewise, when the door is part opened, but not beyond the mid-length positions of the magnet means 19 and 20, as indicated by "+", there will be a repulsion between the magnet means tending to close the door 3. When the door is opened beyond the mid-length of the magnet means 19 and 20 there will be a repulsion tending to move the door to the open position and into contact with the buffers 21.

Referring now to FIGS. 2 & 7, in this arrangement hinging of the door 3 to the door frame stile 9 is by a pair of butt hinges 22. The door mounted member would not have the pin 14 but would have the magnet means 16. The plate 11 would be fastened to the floor as before and would include magnet means 23 and 24 positioned to register with the magnet means 16 on the door 3 when in the closed position and in a part open position. It would be possible to position the magnet means in the position indicated 24*a* where the door 3 can open through 180 degrees with the repulsion of the magnets 16 & 24*a* biassing the door 3 to the fully open position.

The magnet means referred to herein are required to have strong magnetic fields and those termed rare earth magnets have been shown to have sufficiently strong fields to allow the invention to function as described above.

It will be understood that the magnet means 16 can be mounted on top or bottom of the door 3 and that the cooperating member 11 would be appropriately mounted in proximity to the selected end of the door 3.

It will be also be understood that the door 3 can be held in an intermediate position between the closed and open positions, where the bias of the door to the closed and fully open position is not required, by reversing the polarity of the magnet 19. The door 3 could then be manually moved to position the magnet 16 sufficiently close to the changed polarity magnet 19 or 20 of FIG. 3 to have the attraction forces between the poles of the magnets retain the door in the part open position. It follows that in the FIG. 3 arrangement by suitable polarity allocation the magnets 18,19,20 could be used to hold the door closed, partly open and fully open.

What is claimed is:

1. A device for positioning a door, said device comprising:

a flat plate adapted to be flush mounted at a plate position that is under or over a door;

said plate having a straight edge usable for orienting said plate relative to the door;

said plate further having at least one stationary magnet located along an arcuate path on said plate, said path comprising a portion of a circular path and being not a completely circular path;

a door-mountable magnet adapted for attachment to a door-mounting position that is at an upper edge of the door or a lower edge of the door, wherein, when the plate is mounted at the plate position above the door and said door-mountable magnet is attached to the door-mounting position at the upper edge of the door, said at least one stationary magnet and said door-mountable magnet interact with each other to position the door, or wherein, when said plate is mounted at the plate position below the door and said door-mountable magnet is attached to the door-mounting position at the lower edge of the door, said at least one stationary magnet and said door-mountable magnet interact with each other to position the door.

2. The device of claim 1, wherein said plate has through holes for affixing said plate to a flat surface.

3. The device of claim 1, wherein said straight edge includes one of a notch and a recess for aligning said plate to a stile.

4. The device of claim 1, wherein each of said at least one stationary magnet is round.

5. The device of claim 1, wherein each of said at least one stationary magnet is arc shaped.

6. The device of claim 1, wherein said plate further comprises a socket, and further comprising a second plate having a pin, wherein said door-mountable magnet is mounted on said second plate and said socket is adapted to receive said pin for forming a hinge.

7. The device of claim 6, wherein the first-mentioned plate is adapted to a 90 degree opening door.

8. The device of claim 6, wherein the first-mentioned plate is adapted to a 180 degree opening door.

9. The device of claim 6, wherein said at least one stationary magnet includes at least two stationary magnets, at least two of said at least two stationary magnets being oriented in the same polarity.

10. The device of claim 9, wherein said at least two stationary magnets include three magnets including first and second outer stationary magnets and a central stationary magnet between said first and second outer stationary magnets, said first and second outer stationary magnets having a first polarity and said central magnet having a second polarity opposite to said first polarity.

11. The device of claim 6, wherein said at least one stationary magnet includes only three stationary magnets.

12. The device of claim 1, wherein said plate is adapted to a 90 degree opening door.

13. The device of claim 12, wherein said at least one stationary magnet includes at least two stationary magnets, at least two of said at least two stationary magnets being oriented in the same polarity.

14. The device of claim 12, wherein said at least two stationary magnets include three magnets including first and second outer stationary magnets and a central stationary magnet between said first and second outer stationary magnets, said first and second outer stationary magnets having a first polarity and said central magnet having a second polarity opposite to said first polarity.

15. The device of claim 1, wherein said plate is adapted to a 180 degree opening door.

16. The device of claim 15, wherein said at least one stationary magnet includes at least two stationary magnets, at least two of said at least two stationary magnets being oriented in the same polarity.

17. The device of claim 15, wherein said at least two stationary magnets include three magnets including first and second outer stationary magnets and a central stationary magnet between said first and second outer stationary magnets, said first and second outer stationary magnets having a first polarity and said central magnet having a second polarity opposite to said first polarity.

18. The device of claim 1, wherein said at least two stationary magnets include three magnets including first and second outer stationary magnets and a central stationary magnet between said first and second outer stationary magnets, said first and second outer stationary magnets having a first polarity and said central magnet having a second polarity opposite to said first polarity.

19. The device of claim 1, wherein said at least one stationary magnet includes only three stationary magnets.

20. The device of claim 1, wherein said at least one stationary magnet includes at least two stationary magnets, at least two of said at least two stationary magnets being oriented in the same polarity.

21. A device for positioning a door, said device comprising:

a first flat plate to be adapted to be flush mounted under or over a door;

said plate having a straight edge used to orient said plate relative to the door;

said plate retaining one or more stationary magnets located along an arcuate path, said path comprising a portion of a circular path and not a completely circular path;

a door mountable magnet adapted for attachment to an upper or lower edge of a door; and said first flat plate and said door mountable magnet adapted, when mounted, to interact with each other to position the door.

22. The device of claim 21, wherein said plate has through holes for affixing said plate to a flat surface.

23. The device of claim 21, wherein said straight edge further comprises a notch or a recess for aligning said plate with a stile.

24. The device of claim 21, wherein said one or more stationary magnets are round.

25. The device of claim 21, wherein said one or more stationary magnets are arc shaped.

26. The device of claim 21, wherein:

said plate further comprises a socket; and said door mountable magnet is mounted on a second plate, the second plate having a pin, said socket adapted to receive the pin for forming a hinge.

27. The device of claim 21, wherein said first plate is adapted to a 90 degree opening door.

28. The device of claim 21, wherein said first plate is adapted to a 180 degree opening door.

29. The device of claim 21, wherein the stationary magnets are two or more in number, and two or more adjacent ones are oriented in the same polarity.

30. The device of claim 21, wherein the stationary magnets are three only in number and a central stationary magnet is oriented in an opposite polarity to either of the other magnets.

31. The device of claim 21, wherein the stationary magnets are three in number.

32. The device of claim 26, wherein said first plate adapted to a 90 degree opening door.

33. The device of claim 26, wherein said first plate is adapted to 180 degree opening door.

34. The device of claim 26, wherein the stationary magnets are two or more in number and two or more adjacent ones are oriented in the same polarity.

35. The device of claim 26, wherein the stationary magnets are three in number.

36. The device of claim 29, wherein the stationary magnets are three only in number and a central stationary magnet is oriented in an opposite polarity to either of the other magnets.

* * * * *